US009225129B2

(12) United States Patent
Shao et al.

(10) Patent No.: US 9,225,129 B2
(45) Date of Patent: Dec. 29, 2015

(54) ELECTRICAL CONNECTOR

(71) Applicant: HON HAI PRECISION INDUSTRY CO., LTD., New Taipei (TW)

(72) Inventors: Jian Shao, Kunshan (CN); Zheng-Guo Sun, Kunshan (CN); Guo-Hua Zhang, Kunshan (CN); Qi-Sheng Zheng, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/221,271

(22) Filed: Mar. 20, 2014

(65) Prior Publication Data

US 2014/0295712 A1 Oct. 2, 2014

(30) Foreign Application Priority Data

Apr. 2, 2013 (CN) ..... 2013 2 0158806 U

(51) Int. Cl.
*H01R 24/58* (2011.01)
*H01R 105/00* (2006.01)
*H01R 13/6594* (2011.01)

(52) U.S. Cl.
CPC ..... *H01R 24/58* (2013.01); *H01R 13/6594* (2013.01); *H01R 2105/00* (2013.01)

(58) Field of Classification Search
USPC ..... 439/668, 188, 620.24; 200/51.1
See application file for complete search history.

(56) References Cited

U.S. PATENT DOCUMENTS

| | | | | |
|---|---|---|---|---|
| 6,831,843 | B2 * | 12/2004 | Kitamura et al. | 361/800 |
| 6,918,799 | B2 * | 7/2005 | Zhu et al. | 439/862 |
| 7,033,226 | B1 * | 4/2006 | Chien et al. | 439/668 |
| 7,198,504 | B2 * | 4/2007 | Chien et al. | 439/385 |
| 7,238,059 | B1 * | 7/2007 | Wu | 439/668 |
| 7,284,999 | B1 * | 10/2007 | Ju | 439/188 |
| 7,285,024 | B1 * | 10/2007 | Tai | 439/668 |
| 7,387,543 | B1 * | 6/2008 | Wu et al. | 439/668 |
| 7,534,146 | B2 * | 5/2009 | Chien et al. | 439/668 |
| 7,959,472 | B1 * | 6/2011 | Huang | 439/668 |
| 8,070,528 | B2 * | 12/2011 | Wang et al. | 439/668 |
| 8,216,000 | B2 * | 7/2012 | Su et al. | 439/668 |
| 8,287,314 | B1 * | 10/2012 | Gao et al. | 439/668 |

FOREIGN PATENT DOCUMENTS

CN 201063398 Y 5/2008

* cited by examiner

*Primary Examiner* — Alexander Gilman
(74) *Attorney, Agent, or Firm* — Wei Te Chung; Ming Chieh Chang

(57) ABSTRACT

An electrical connector has an insulative housing, a plurality of contacts retained in the insulative housing and a shell assembled to the insulative housing. The insulative housing has a mating face and a mating chamber depressing from the mating face and extending through the insulative housing along a front to back direction for receiving a mating plug. The contacts comprise a first contact with a first engaging point located in a left side of the mating chamber, and a second contact with a second engaging point located in a bottom side of the mating chamber and a third contact with a third engaging point located in a right side of the mating chamber and opposite to the first contacting portion, the third engaging point is located between the first engaging point and the second connecting portion along the front to back direction.

19 Claims, 5 Drawing Sheets

ELECTRICAL CONNECTOR

BACKGROUND OF THE INVENTION

1. Field of the Invention

The present invention relates to an electrical connector, more particularly to an electrical connector with a contact presented as a signal contact or a grounding contact at different situations.

2. Description of Related Art

An audio jack for mating with a 2-pole concentric plug usually has two terminals, the two terminals include a grounding contact and a signal contact. Such as Chinese patent issue No. CN 201063398Y issued on May. 21, 2008, discloses a jack with a mating chamber, and only a grounding contact and a signal contact disposed in a front side of the mating chamber for mating with different parts of a 2-pole contact of a concentric plug. The audio jack only has two contacts for mating with the mating concentric plug, so if the concentric plug changes its number of poles, the audio jack will unable to mate with the changed concentric plug and can not transmit singles via the plug and the audio jack. As a result, the audio jack only can be used in one situation.

Hence, an improved electrical connector is needed to solve the problem above.

BRIEF SUMMARY OF THE INVENTION

An electrical connector has an insulative housing with a mating face and a mating chamber depressing from the mating face and extending through the insulative housing along a front to back direction for receiving a mating plug. A shell is assembled to insulative housing. A plurality of contacts are retained in the insulative housing, each of the contacts has a first contact with a first contacting portion located in a left side of the mating chamber, and a second contact with a second contacting portion located in a bottom side of the mating chamber. The contacts further comprise a third contact with a third contacting portion located in a right side of the mating chamber and opposite to the first contacting portion, the third contacting portion is located between the first contacting portion and the second contacting portion along the front to back direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-5, an electrical connector 100 is a concentric jack and includes an insulative housing 1, a plurality of contacts 2 retained in the insulative housing 1 and a shell 3 enclosing the insulative housing 1.

Figure 1:
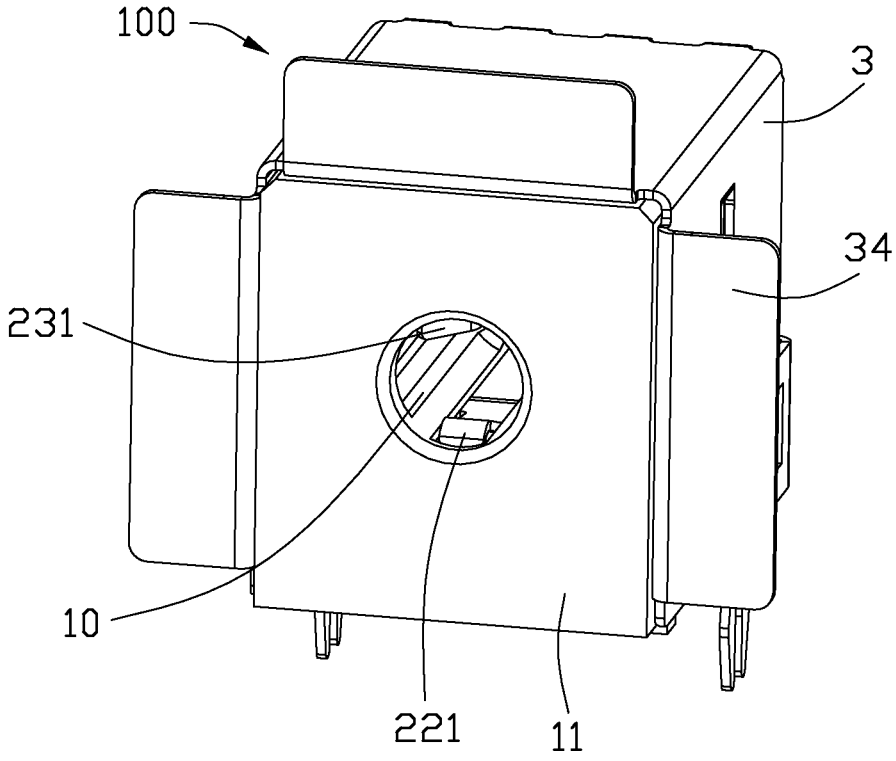
FIG. 1 is a perspective view of an electrical connector according to the preferred embodiment of the present invention.
Figure 2:
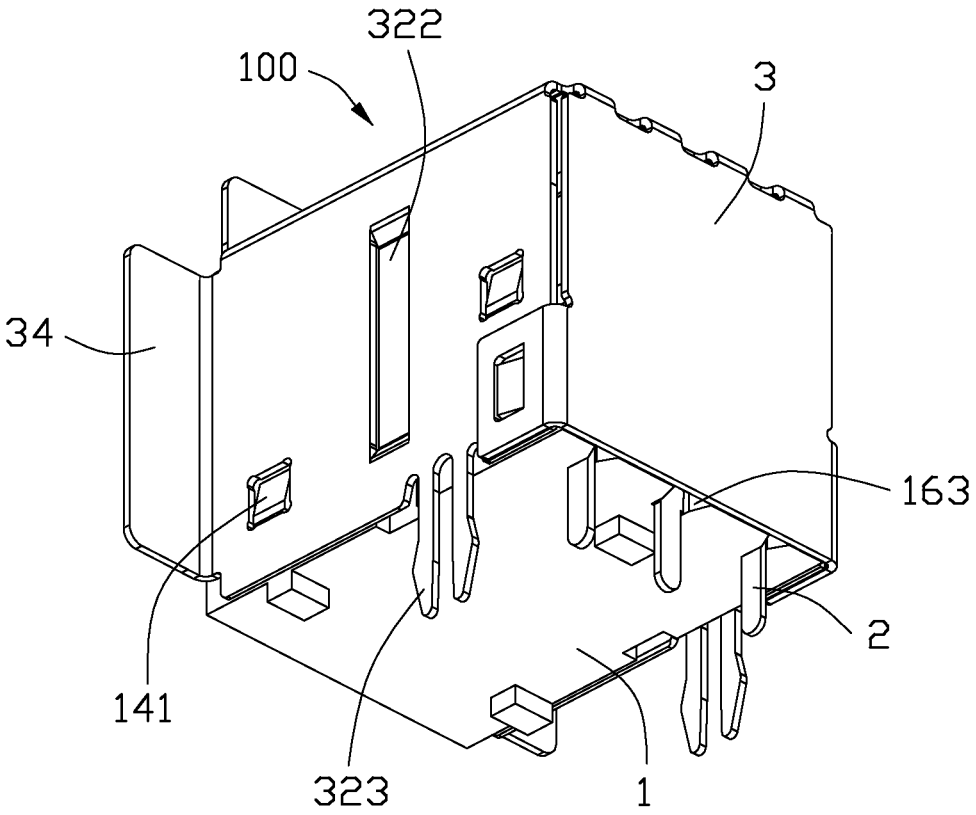
FIG. 2 is similar to FIG. 1, but taken from another aspect.
Figure 3:
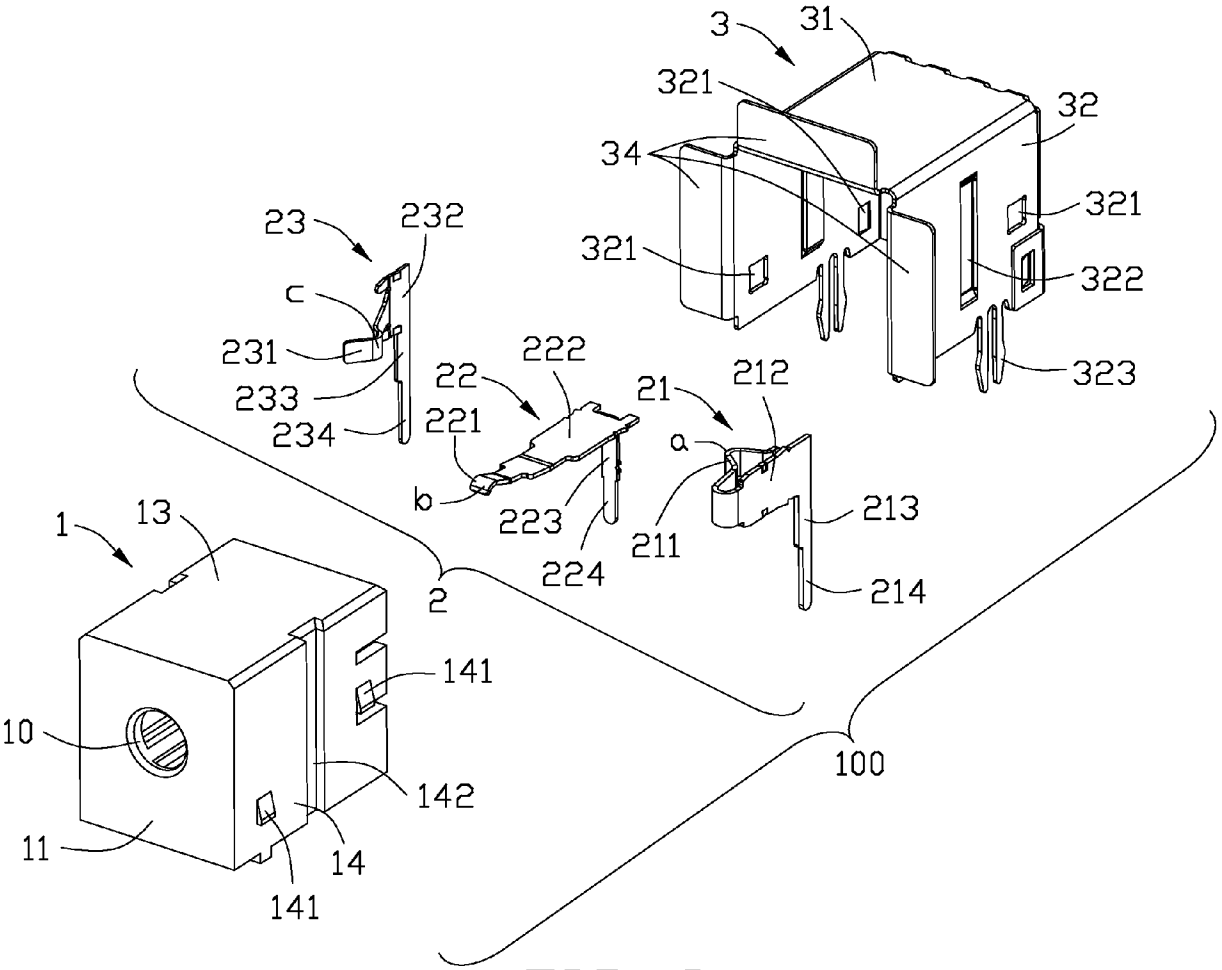
FIG. 3 is an exploded, perspective view of the electrical connector.
Figure 4:
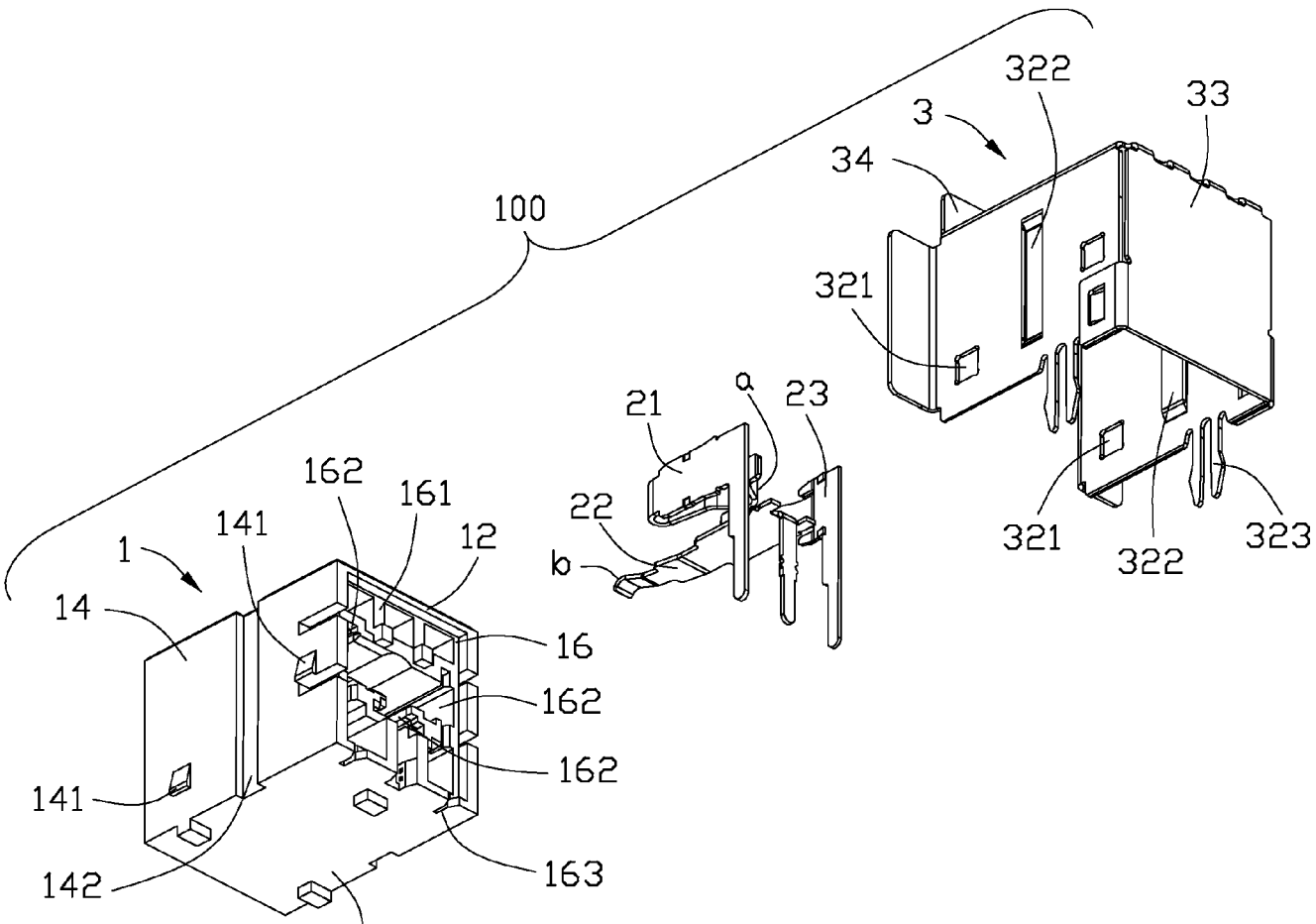
FIG. 4 is similar to FIG. 3, but taken from another aspect.

Referring to FIGS. 2-4, the insulative housing 1 showing as a rectangle cube, comprises a mating face 11, a rear face 12 opposite to the mating face 11, a top portion 13 located of a top side of the rectangle cube, a bottom portion 15 opposite to the top portion 13, two side portions 14 connecting with the mating face 11 and the rear face 12 at two sides of the rectangle cube, and a mating chamber 10 recessed from the mating face 11 and extending through the rear face 12. The insulative housing 1 further has a plurality of protrusions 141 at a front side and a rear side thereof and two depressing slots 142 depressed on the two side portions 4 respectively and extending through the top portion 13 and the bottom portion 15 along a vertical direction. The insulative housing further has a room 16 is recessed from the rear wall 12, and the room 16 has an inner wall 161, a plurality of receiving slots 162 for receiving the contacts 2 and a plurality of positioning slot 163. The receiving slots 162 are depressed forwardly from the inner wall 161 and communicated with the mating chamber 10. The positioning slots 163 extend through the bottom portion 15 of the insulative housing 1 along a vertical direction. The receiving slots 162 and the positioning slots 163 are both communicated with the room 16, and the receiving slots 162 do not extend forwardly through the mating face 11.

The contacts 2 received in the mating chamber 10 include a first contact 21 located closed to one of the side portions 14, a second contact 22 located closed to the bottom portion 15, and a third contact 23 located closed to another side portion 14 and opposite to the first contact 21.

Reference to FIGS. 3 and 4, the first contact 21 is shown in a schistose structure extending vertically and has a first retaining portion 212 extending forwardly into the mating chamber 10 and retained in one of the receiving slots 162 which is closed to one of the side portions 14, a first extending portion 213 extending from a rear and bottom side of the first retaining portion 212 and downwardly to being received in the positioning slot 163, a first soldering/tail portion 214 extending downwardly from a bottom end of the first extending portion 213 and a first contacting portion 211 extending backwardly from a front end of the first retaining portion 212. The first contacting portion 211 has an arc shape protruding toward the mating chamber 10. The first contacting portion 211 extends toward the rear face 12 along a front to back direction and is located at a rear side of the mating chamber 10 while the first retaining portion 212 extends toward the mating face 11 along a back to front direction and is located at a front side of the mating chamber 10. The first retaining portion 212 has a plurality of lances (not labeled) at a bottom edge thereof to abut against an inner wall of the receiving slot 162.

The second contact 22 has a second retaining portion 222 extending forwardly from the back to front direction and being received in the receiving slot 162, a second extending portion 223 bent and extending downwardly from a rear end of the second retaining portion 222, a second soldering/tail portion 224 extending downwardly and received in the positioning slot 163 and a second contacting portion 221 disposed at a front end of the second retaining portion 222 and exposed in the mating chamber 10 closed to the mating face 11. The second retaining portion 222 has a plurality of lances (not labeled) at a bottom edge thereof to abut against with an inner wall of the receiving slot 162.

The third contact 23 has a third retaining portion 232 opposite to the first retaining portion 212, a third extending portion 233 extending from a rear end of the third retaining portion 232, a third soldering/tail portion 234 extending downwardly from a bottom end of the third extending portion 233 and a third contacting portion 231 extending forwardly from the third retaining portion 232 and protruding into the mating chamber 10. The third retaining portion 232 is positioned in the receiving slot 162. The third retaining portion 232 has a plurality of lances (not labeled) at a bottom edge thereof to abut against an inner wall of the receiving slot 162.

The first contacting portion 211 has a first engaging/contacting point a, the second contacting portion 221 has a second engaging/contacting point b, and the third contacting portion 231 has a third engaging/contacting point c. In the front to back direction, the third engaging point c is located between the first engaging point a and the second engaging point b and a distance between the third engaging portion c and the first engaging portion a is shorter than a distance between the second engaging portion b and the third engaging portion c. In such arrangement, when a 2-pole concentric plug (not shown) with a two steps male terminal is inserted into the mating chamber 10 of the electrical connector 100, the first engaging point a touch a front end of the 2-pole concentric plug and the second engaging point b and the third engaging point c both connect with a rear end of the male terminal of the 2-pole concentric plug. So, the first contact 21 is used as a signal contact as a right sound track contact, the second contact 22 and the third contact 23 are used as grounding contacts. When a 3-pole or a 4-pole concentric plug (not shown) is inserted into the mating chamber 10 of the electrical connector 100, the first engaging point a of the first contacting portion 211 still connects with a front end of a male terminal of the 3-pole or 4-pole concentric plug, the second engaging point b of the second contacting portion 221 still connects with a rear end of the male terminal of the 3-pole or 4-pole concentric plug, and the third engaging point c of the third contacting portion 231 connects with a middle portion of the male terminal of the 3-pole or 4-pole concentric plug. So, the first contact 21 is still used as a signal contact as a right sound track contact, the second contact 22 is still used as a grounding contact, and the third contact 23 is used as another signal contact, a left sound track contact. So the third contact 23 can be used as a signal contact or a grounding contact in different conditions. At the same time, the third contacting portion 231 is set opposite to the first contacting portion 211 which can give a balance force to the 2-pole, 3-pole or 4-pole concentric plug.

Referring to FIGS. 3 to 4, the shell 3 has a top wall 31 located over the top portion 13 of the insulative housing 1, two sidewalls 32 covering the two side portions 14 of the insulative housing 1 and a rear wall 33 covering over the rear face 12. The top wall 31 and the two side walls 32 all have an elastic plate 34 bent outwardly from front edges thereof. The elastic plates 34 extend beyond the mating face 11 of the insulative housing 1. Each side wall 32 has a locking hole 321 to lock with the protrusion 141 of the side portion 14 of the insulative housing 1, a locking portion 322 tore from the side wall 32 and extending inwardly to lock with the depressing slot 142 of the insulative housing 1, and a pair of tines 323 extending from bottom edges of the two side walls 32 to lock with a printed circuit board (not shown).

Figure 5:
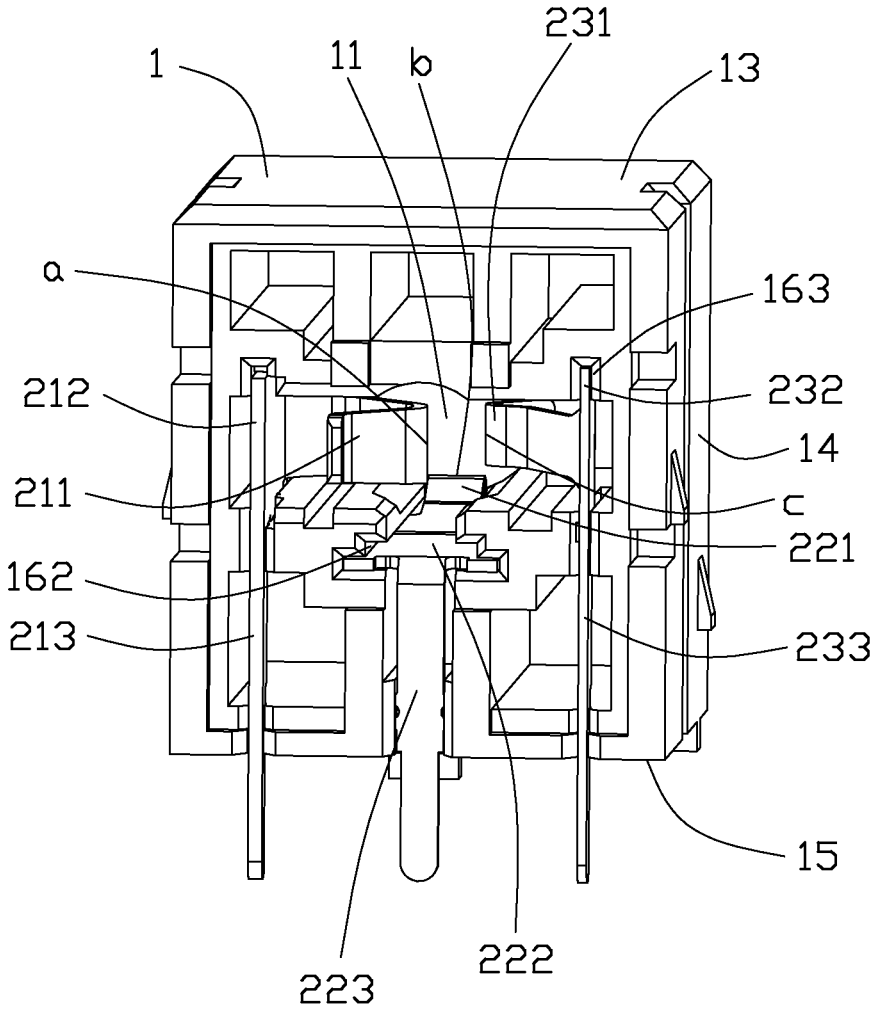
FIG. 5 is a view of the electrical connector with its shell removed therefrom.

Referring to FIG. 5, the first, second and third contacts 21, 22, 23 are all assembled in the receiving slots 162 respectively along the back to front direction. The first, second and third contacting portions 211, 221, 231 are disposed in the mating chamber 10. The first, second and third extending portions 213, 223, 233 are positioned in the positioning slots 163 respectively. Please take a view from a back side of the electrical connector 100 with its shell 3 removed away thereof, the second contacting portion 221 protrudes upwardly into the mating chamber 10, the first contacting portion 211 protrudes into the mating chamber 10 from a left side and the third contacting portion 231 protruded into the mating chamber 10 from a right side. It is noted because the contacts 21, 22 and 23 are made from sheet metal defined by an extension face and a thickness face perpendicular to each other, the tail portion 214/234 lies in a plane which is perpendicular to another plane in which the tail portion 224 lies. Under this arrangement, each engaging point may have reliable contact with the inserted plug.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector comprising:

an insulative housing having a mating face and a mating chamber depressing from the mating face and extending through the insulative housing along a front to back direction for receiving a mating plug;

a shell assembled to insulative housing; and a plurality of contacts retained in the insulative housing, the contacts comprising a first contact with a first contacting portion located in a left side of the mating chamber, and a second contact with a second contacting portion located in a bottom side of the mating chamber; wherein the contacts further comprise a third contact with a third contacting portion located in a right side of the mating chamber and opposite to the first contacting portion, the third contacting portion is located between the first contacting portion and the second contacting portion along the front to back direction; wherein each of the contacts has a soldering portion respectively, and the soldering portions are aligned with each other.

2. The electrical connector as claimed in claim 1, wherein the first contacting portion is closed to a rear side of the mating chamber, the second contacting portion is closed to a front side of the mating chamber and near to the mating face.

3. The electrical connector as claimed in claim 2, wherein the first contacting portion has a first engaging point, the second contacting portion has a second engaging point, the third contacting portion has a third engaging point, a distance between the first engaging point and the third engaging point is shorter than that between the second engaging point and the third engaging point along the front to back direction.

4. The electrical connector as claimed in claim 3, wherein the second contacting portion protrudes upwardly into the mating chamber, the first contacting portion protrudes into the mating chamber from a left side and the third contacting portion protrudes into the mating chamber from a right side via taking a view from a back side of the electrical connector with its shell removed away thereof.

5. The electrical connector as claimed in claim 2, wherein the insulative housing has a rear face opposite to the mating face, a plurality of receiving slots depressing from the rear face and not extending through the mating face along a back to front direction, the receiving slots communicate with the mating chamber.

6. The electrical connector as claimed in claim 1, wherein the insulative housing further has a room recessed on the rear face, the contacts are assembled to the insulative housing along the back to front direction, each contact has an extending portion disposed in the room.

7. The electrical connector as claimed in claim 6, wherein the insulative has an inner wall located in an inner side of the room, the receiving slot is depressed from the inner wall and extends forwardly.

8. The electrical connector as claimed in claim 7, wherein the inner wall has a plurality of positioning slots for receiving the extending portions of the contacts, the positioning slots extending through a bottom portion of the insulative housing along an upper to down direction.

9. The electrical connector as claimed in claim 1, wherein the shell comprises a top wall, two side walls and a plurality of elastic plates bent from front edges of the top wall and two side walls, the elastic plates are all beyond the mating face.

10. An electrical connector comprising:

an insulative housing defining a cylindrical mating chamber communicating forwardly with an exterior in a front-to-back direction;

a first contact disposed in the housing at a 0 degree position of the cylindrical mating chamber in a front view;

a second contact disposed in the housing at one of 90 or 270 degrees position of the cylindrical mating chamfer in the front view;

a third contact disposed in the housing at a 180 degrees position of the cylindrical mating chamfer in the front view, each of said first contact, said second contact and said third contact including a front forwardly extending contact portion and a rear downwardly extending tail portion, and made from sheet metal defining an extension face and a thickness face perpendicular to each other; wherein the rear tail portion of the first contact extends in a first plane perpendicular to a second plane in which the rear tail portion of the second contact extends while parallel to a third plane in which the rear tail portion of the third contact extends; wherein a contacting point of the front contacting portion of the third contact is positioned between those of the first contact and the second contact in the front-to-back direction; wherein the rear tail portions of all said first, second and third contacts are generally aligned with one another in a transverse direction perpendicular to said front-to-back direction.

11. The electrical connector as claimed in claim 10, wherein the front contacting portion of the first contact is of a backward folded type while those of both said second and third contacts are of a forward extension type.

12. The electrical connector as claimed in claim 10, wherein the first contact includes a retention structure to retain the first contact in the housing, and said retention structure generally is formed on the first plane in which the rear tail portion of the first contact lies, and the third contact includes another retention structure to retain the third contact in the housing, and said another retention structure generally is formed on the third plane in which the rear tail portion of the third contact lies.

13. The electrical connector as claimed in claim 10, wherein the second contact includes a lower retention structure formed on the rear tail portion thereof and an upper retention structure on a horizontal plane above the rear tail portion thereof.

14. The electrical connector as claimed in claim 10, wherein the housing forms a locking protrusion on each of opposite side exterior faces, and a pair of horizontal slots are located by two sides of the locking protrusion to provide deformability around the locking protrusion for easy assembling a metallic shell upon the housing, said shell defining a pair of locking openings each to latchably receive the corresponding locking protrusion therein.

15. The electrical connector as claimed in claim 14, wherein said shell includes a pair of side walls and a rear wall equipped with retention mechanism to secure the rear wall to the corresponding side wall, and said retention mechanism is essentially aligned with the corresponding locking protrusion in a vertical direction perpendicular to said front-to-back direction.

16. The electrical connector as claimed in claim 10, wherein the housing includes a plurality of rearwardly exposed positioning slots to receive the corresponding tail portions, respectively.

17. The electrical connector as claimed in claim 16, wherein the positioning slot receiving the tail portion of the second contact is wider than those receiving the tail portions of the first contact and the third contact.

18. The electrical connector as claimed in claim 17, wherein the tail portion of the second contact forms sideward barbs to be engaged within the corresponding positioning slot in an interference fit for securing consideration.

19. An electrical connector comprising:

an insulative housing defining a cylindrical mating chamber communicating forwardly with an exterior in a front-to-back direction;

a first contact disposed in the housing at a 0 degree position of the cylindrical mating chamber in a front view;

a second contact disposed in the housing at one of 90 or 270 degrees position of the cylindrical mating chamfer in the front view;

a third contact disposed in the housing at a 180 degrees position of the cylindrical mating chamfer in the front view, each of said first contact, said second contact and said third contact including a front forwardly extending contact portion, a middle retaining portion and a rear downwardly extending tail portion, and made from sheet metal defining an extension face and a thickness face perpendicular to each other; wherein the rear tail portion of the first contact extends in a first plane perpendicular to a second plane in which the rear tail portion of the second contact extends while parallel to a third plane in which the rear tail portion of the third contact extends; wherein a contacting point of the front contacting portion of the third contact is positioned between those of the first contact and the second contact in the front-to-back direction; wherein the housing defines a plurality of receiving slots to respectively receive the corresponding retaining portions of the contacts, and a plurality of positioning slots to respectively receive the corresponding tail portions of the contacts; wherein the positioning slots are rearwardly exposed to an exterior to allow the contacts to be forwardly assembled into the housing from a rear side of the housing; wherein the positioning slots are located lower than the receiving slots, the positioning slot to receive the tail portion of the second contact is wider than those to receive the first contact and the third contact, and the tail portion of the second contact is further equipped with sidewardly extending barbs engaged within the positioning slot in an interference fit.

* * * * *